United States Patent [19]

Yamada et al.

[11] Patent Number: 4,633,500

[45] Date of Patent: Dec. 30, 1986

[54] SPEECH SYNTHESIZER

[75] Inventors: Norimasa Yamada; Masahiro Hibino, both of Hyogo, Japan

[73] Assignee: Mitsubishi Denki Kabushiki Kaisha, Tokyo, Japan

[21] Appl. No.: 476,287

[22] Filed: Mar. 17, 1983

[30] Foreign Application Priority Data

Mar. 19, 1982 [JP] Japan ..... 57-45085

[51] Int. Cl.[4] ..... G10L 5/00

[52] U.S. Cl. ..... 381/51; 84/1.01

[58] Field of Search ..... 381/29-53; 84/1.01

[56] References Cited

U.S. PATENT DOCUMENTS 4,509,188 4/1985 Suzuki ..... 381/53

4,542,524 9/1985 Laine ..... 381/53

*Primary Examiner*—E. S. Matt Kemeny

*Attorney, Agent, or Firm*—Sughrue, Mion, Zinn, Macpeak, and Seas

[57] ABSTRACT

A speech synthesizer includes a lattice-type multi-stage digital filter modified in the next to last stage thereof by incorporating an increasing circuit for slightly effectively increasing the absolute value of a parameter $K_2$ so as to reduce an attenuation factor. The device is useful for generating tones of a sustained quality, such as musical tones.

6 Claims, 10 Drawing Figures

SPEECH SYNTHESIZER

BACKGROUND OF THE INVENTION

This invention relates to a partial auto correlation type speech synthesizer in which voice waveforms are analyzed to extract characteristic parameters, the characteristic parameters thus extracted are transferred to memory means at a given rate (hereinafter referred to as "a frame period"), and with the air of digital filter, voice waveforms are synthesized and outputted according to the characteristic parameters.

Most speech synthesizers which are practically used are of the partial auto correlation type. Circuits for synthesizing the voice waveforms are integrated on one silicon chip. Such a speech synthesizer is, in general, obtained by integrating function circuits 100 on the synthesis side of an analysis and synthesis system as shown in FIG. 1.

In FIG. 1, reference numeral 300 designates a parameter file which is adapted to store characteristic parameters of voices which have been analyzed and extracted by an analyzer 200.

The speech synthesizer comprises essential components which are arranged as shown in the block diagram of FIG. 2. More specifically, the speech synthesizer comprises decoders 110, 120 and 130 for decoding the pitch, voiced/unvoiced discrimination code, the amplitude and the partial auto correlation coefficients (so-called K parameters) of the characteristic data D which is extracted from a voice waveform and is quantized by the analyzer 200 in FIG. 1; memories 111, 121 and 131 for temporarily storing the parameters thus decoded, respectively; a pulse generating circuit 112 for producing a train of pulses corresponding to the value of the pitch parameter output by the memory 111; a white noise generating circuit 113 for generating white noise which is used as a exciting signal for unvoiced sound; a exciting signal selecting circuit 114 for selecting either the pulse train or the white noise signal as a exciting signal according to the voiced or unvoiced discrimination code; an amplitude multiplication circuit 140 for multiplying a exciting signal by the content of the amplitude memory 121; a digital filter 150 for extracting a predetermined frequency spectrum component from the exciting signal using a filter coefficient corresponding to the content of the K parameter memory 131; and a D/A converter 160 for converting a digital value provided by the digital filter 150 into an analog signal.

The speech synthesizer further comprises a timing signal generating circuit (not shown) for operating the various above-described circuit elements with suitable timing; and an interface circuit (not shown) for sequentially loading the time-series data, which are obtained by voice analysis and are stored in external memories, in the decoders 110, 120 and 130.

In such a speech synthesizer, the analysis data is subjected to compression, in order to more economically use the memory which stores the voice data. Even when a one second voice interval is compressed to the extent of about 2000 bits, the clarity is maintained substantially unchanged; that is, the method is practical. There is a variety of known voice compressing methods. In one example, the amplitude parameter is assigned 4 to 6 bits, the pitch parameter is assigned 5 to 6 bits, and in the case of the K parameters, $K_1$ through $K_{10}$ are assigned to 5, 5, 4, 4, 4, 4, 4, 3, 3 and 3 bits, or 7, 5, 4, 4, 4, 3, 3, 3, 3, and 3 bits in the stated order, in what is called a "non-uniform bit distribution".

The decoders 110, 120 and 130 in FIG. 2 operate to decode these quantized parameter codes into the true values of analysis data, thus forming tables having the numbers of words corresponding to the respective numbers of bits. Generally, because of a limitation in the formation of circuits, the digital value to be decoded has an accuracy of 10 bits.

The above-described speech synthesizer can provide quite a natural synthesized voice using a small voice data memory. However, the speech synthesizer cannot provide a musical tone of high quality such as a sinusoidal wave because of the spectral distortion due to quantitization, or because of a high modulation noise due to the unsatisfactory matching of the exciting signal frequency to the pole frequency of the digital filter.

The digital filter 150 is a multistage lattice-type filter which, as shown in FIG. 3, comprises an adder/subtractor 151, a multiplier 152 and a delay unit 153.

SUMMARY OF THE INVENTION

An object of this invention is to provide a partial auto correlation type speech synthesizer, in which voice waveforms are analyzed to extract characteristic parameters, the characteristic parameters thus extracted are transferred to memory means at predetermined time intervals and, with the aid of a digital filter, voice waveforms are synthesized and outputted according to the characteristic parameters.

The foregoing object and other objects of the invention have been achieved by the provision of a partial auto correlation speech synthesizer having, as fundamental components, a lattice-type multi-stage digital filter including a digital exciting signal generating circuit, an adder/subtractor, a delay unit and a multiplier, for extracting a predetermined frequency spectrum component from a exciting signal; in which, according to the invention, an increasing circuit for slightly increasing the absolute value of a multiplication result is provided for the coefficient K parameter multiplier in a predetermined stage of the lattice-type multistage filter, so that a sinusoidal waveform sustained under steady conditions or a damped oscillation waveform of a long attenuation time is synthesized and outputted.

The nature, principle and utility of this invention will become more apparent from the following detailed description and the appended claims when read in conjunction with the accompanying drawings.

DETAILED DESCRIPTION OF THE PREFERRED EMBODIMENTS

Figure 1:
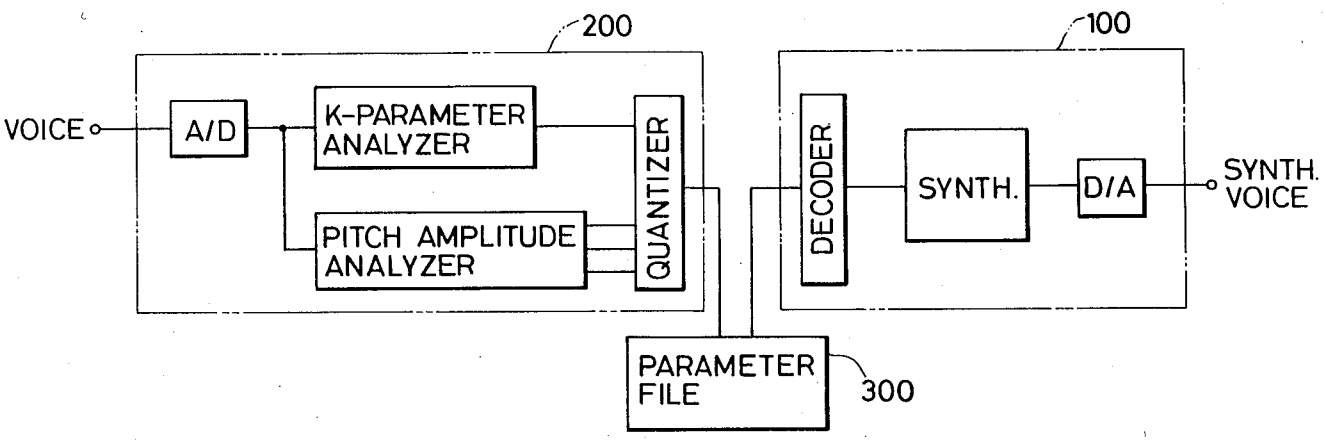
FIG. 1 PRIOR ART
FIG. 1 is a block diagram showing a conventional partial auto correlation type speech analysis and synthesis system.
Figure 3:
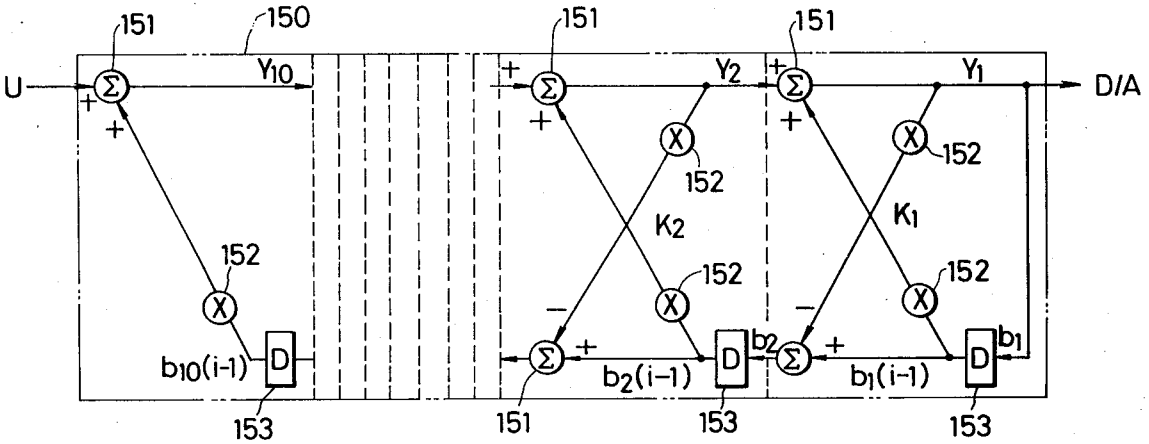
FIG. 3 PRIOR ART
FIG. 3 is an explanatory diagram showing the circuit of a conventional lattice-type multistage digital filter.
Figure 2:
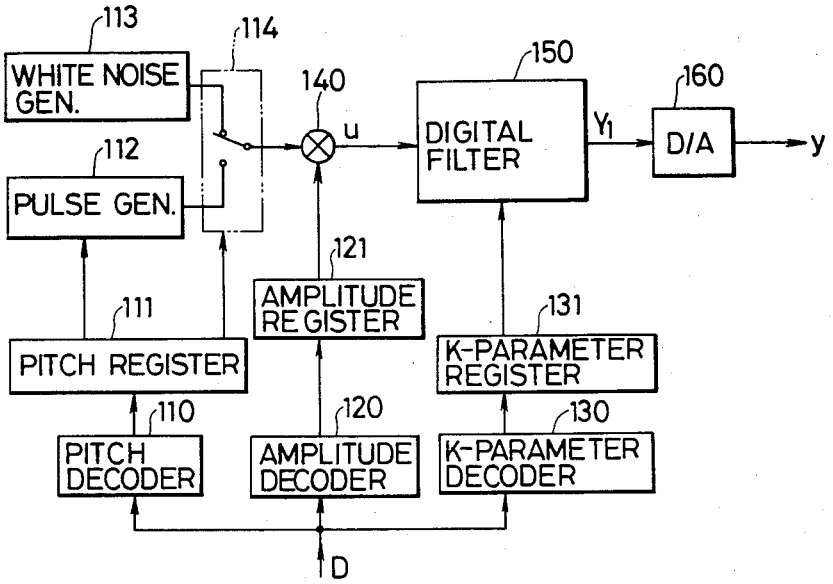
FIG. 2 PRIOR ART
FIG. 2 is a block diagram showing the essential elements of a conventional speech synthesizer.

The invention is intended not only to improve the above-described speech synthesizer, but also to synthesize musical tones of sinusoidal waveforms or the like and to form melodies.

The principle of this invention will be described below.

The transfer function of a full pole type digital filter can be represented by the following expression (1) when the number of poles=1.

$$H(Z)=A/(1+a_1Z^{-1}+a_2Z^{-2}) \quad (1)$$

where $Z=e^{-\rho+j2\pi fT}$, $j=\sqrt{-1}$ $\rho$ is the attenuation constant, $a_i$ is the linear prediction coefficient, f is the frequency, and T is the sampling period.

If the pole frequency is represented by fr in the aforementioned expression, then from simultaneous equations with the denominator of expression (1) being equal to zero, $$a_1=-2e^{-\rho}\cos 2\pi frT$$

$$a_2=e^{-2\rho} \quad (2)$$

On the other hand, the impulse response of this filter can be represented by the following expression (3):

$$x_i=Ae^{-\rho i}\sin 2\pi friT \quad (3)$$

Expression (3) represents a damped oscillation waveform which is suitable for musical tones.

The linear prediction coefficients are related to the parameter K of the partial auto correlation coefficient through mathematical conversion using the following expressions (4):

$$K_1=-a_1/(1-a_2)$$

$$K_2=-a_2 \quad (4)$$

Therefore, $$\begin{aligned} fr &= (\tfrac{1}{2}\pi T)\cos^{-1}[(1+e^{-2\rho})K_1/(2e^{-\rho})] \\ &= (\tfrac{1}{2}\pi T)\cos^{-1}[(1-K_2)K_1/(2\sqrt{-K_2})] \\ \rho &= -(\tfrac{1}{2})\ln(-K_2) \end{aligned} \quad (5)$$

It will be readily understood that the frequency of the damped oscillation waveform is defined by the parameters $K_1$ and $K_2$, and the attenuation constant is defined by the parameter $K_2$. When $K_2$ ranges from $-0.95$ to $-1.0$ in the above expression, the effect of $K_2$ on the pole frequency is 1% or less, and accordingly tonal intervals remain regular in the human hearing sense. In this case, expression (5) can be approximated by the following expression (6):

$$fr\approx(\tfrac{1}{2}\pi T)\cos^{-1}K_1 \quad (6)$$

The aforementioned range of $K_2$ corresponds to an attenuation constant range of 0 to 0.0256. In case of the attenuation constant being 0, the waveform shows a steady sinusoidal waveform. On the other hand, in case of the attenuation constant being 0.0256, the waveform shows a damped oscillation waveform the amplitude of which is attenuated to 1/e within about 40 sampling periods. This is close to the damping characteristic of a natural musical instrument such as a piano, thus being suitable for musical tones.

On the other hand, the arithmetic algorithm of a ten-stage digital filter for voice includes successive calculating expressions as shown in Table 1 below:

TABLE 1

| Equation | Stage |
|---|---|
| $Y_{11}(i) = U(i)$ | |
| $Y_{10}(i) = Y_{11}(i) + K_{10}b_{10}(i-1)$ | 10 |
| $Y_9(i) = Y_{10}(i) + K_9b_9(i-1)$ | 9 |
| $b_{10}(i) = b_9(i-1) - K_9Y_9(i)$ | 9 |
| $Y_8(i) = Y_9(i) + K_8b_8(i-1)$ | 8 |
| $b_9(i) = b_8(i-1) - K_8Y_8(i)$ | 8 |
| $Y_7(i) = Y_8(i) + K_7b_7(i-1)$ | 7 |
| $b_8(i) = b_7(i-1) - K_7Y_7(i)$ | 7 |
| $Y_6(i) = Y_7(i) + K_6b_6(i-1)$ | 6 |
| $b_7(i) = b_6(i-1) - K_6Y_6(i)$ | 6 |
| $Y_5(i) = Y_6(i) + K_5b_5(i-1)$ | 5 |
| $b_6(i) = b_5(i-1) - K_5Y_5(i)$ | 5 |
| $Y_4(i) = Y_5(i) + K_4b_4(i-1)$ | 4 |
| $b_5(i) = b_4(i-1) - K_4Y_4(i)$ | 4 |
| $Y_3(i) = Y_4(i) + K_3b_3(i-1)$ | 3 |
| $b_4(i) = b_3(i-1) - K_3Y_3(i)$ | 3 |
| $Y_2(i) = Y_3(i) + K_2b_2(i-1)$ | 2 |
| $b_3(i) = b_2(i-1) - K_2Y_2(i)$ | 2 |
| $Y_1(i) = Y_2(i) + K_1b_1(i-1)$ | 1 |
| $b_2(i) = b_1(i-1) - K_1Y_1(i)$ | 1 |
| $b_1(i) = Y_1(i)$ | |

In these equations, $Y_m$ and $b_m$ are the intermediate values, at a stage m, of the forward and backward waves in a lattice-type filter, respectively, and (i) is the sampling number. The filter output is represented by $b_1(i)$. The successive calculating expressions in Table 1 above function as a one-pole digital filter in the case of $K_3-K_{10}=0$. In the case where linear predictive coefficients $a_1$ and $a_2$ are employed, the successive calculation expressions are equivalent to the following expression (7) with the expression (4) taken into consideration:

$$X_n=U+a_1X_{n-1}+a_2X_{n-2} \quad (7)$$

where $X_n$ is the waveform value at the n-th sampling point, $X_{n-1}$ and $X_{n-2}$ are the waveform values at sampling points earlier by one and two sampling points than the n-th sampling point, respectively, and U is the exciting signal value.

The data $X_i$ of the impulse response expression (3) of the digital filter, which is defined by the transfer function of expression (1), coincides with the data $X_n$ with the tone source signal value U as the impulse.

An invention is known in which, according to the above-described principle, the parameters $K_1$ and $K_2$ are defined by the expressions $K_1=\cos 2\pi\ frT$ and $K_2=-e^{-2\pi}$, these values being stored in the memory of a decoder, and a digital filter is driven by impulse, to thereby obtain a damped oscillation waveform. A speech synthesizer according to that invention is disadvantageous in that where a conventional lattice-type digital filter (150) for voice is employed, the filter is not sufficiently high in calculation accuracy and the decoded value of the parameter is not high in accuracy, and thus the resultant damped oscillation waveform is different from that theoretically determined.

Heretofore, the multiplication accuracy of the lattice-type digital filter has been of the order of 14 bits, and the accuracy of the decoded value of the order of 10 bits. It has been found through simulation with a computer that, in this case, the damped oscillation waveform obtained has an attenuation time of not more than 0.2 second. One of the important causes of this is the accumulation of rounding errors in the digital calculation. Another is that the minimum value of the decoded value of the parameter $K_2$ (the minimum value being $-1.0$ theoretically, and $\rho=0$ in this case; i.e., a steady sinusoidal waveform is provided) becomes greater than $-1.0$, depending on the accuracy. For instance, in the case where the accuracy is of 10 bits, the minimum value of $K_2$ is about $-0.998$, and the attenuation time is about 0.125 second with a sampling frequency of 8 KHz.

This invention is intended to eliminate these drawbacks accompanying a conventional speech synthesizer, and to obtain a steady sinusoidal waveform or a damping oscillation waveform of long attenuation time without increasing the size of the speech synthesizer.

Figure 4:
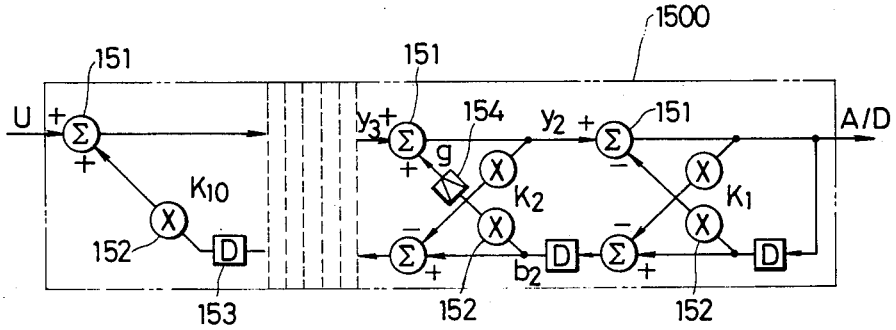
FIG. 4 is an explanatory diagram showing one embodiment of this invention for describing the principle of the invention.

FIG. 4 shows one example of a digital filter 1500 of a speech synthesizer according to this invention.

In FIG. 4, reference numeral 154 designates an increasing circuit, which is one of the essential elements of the invention. The function and the arrangement of the increasing circuit 154 are more concretely shown in FIGS. 5 and 6.

Figure 5:
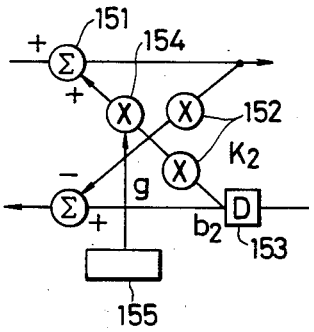
FIGS. 5 through 10 are explanatory diagrams showing the arrangements of other embodiments of the invention.

The increasing circuit 154 is provided to increase the multiplication result of a backward wave $b_2$ at the stage one stage prior to the last stage, and the parameter $K_2$. As shown in FIG. 5, the output value g of a read-only-memory (or a register) 155 in which predetermined increasing rates have been stored and the multiplication result $K_2 \times b_2$ of a multiplier 152 are subjected to multiplication in a multiplier 154, the output of which is applied to an adder 151. In the operation, the increasing rate g is selected so that it corresponds to the calculation accuracy of the digital filter 1500. For instance, in the case where the accuracy of the decoded value of the parameter K is 10 bits and the calculation accuracy of the multiplication 152 or the like is of 14 bits, an increasing rate of the order of $1+1/1000$ to $1+1/250$ should be selected.

The insertion of this circuit provides the following effects: In a conventional digital filter 150, the value applied to the adder 151 is $K_2 \times b_2(i-1)$. On the other hand, in the digital filter 1500 according to the invention, the value is $g \times K_2 \times b_2(i-1)$; that is, a value which is obtained by equivalently multiplying the absolute value of $K_2$ by the data g is input to the adder 151. By taking into consideration that only the parameter $K_2$ affects the attenuation factor and the data $K_2$ is used only for the multiplication $K_2 \times b_2(i-1)$ in this stage, it will be understood that the increasing circuit 154 actually increases the absolute value of $K_2$, thus being a means for obtaining a damped oscillation waveform which is of smaller attenuation.

Figure 6:
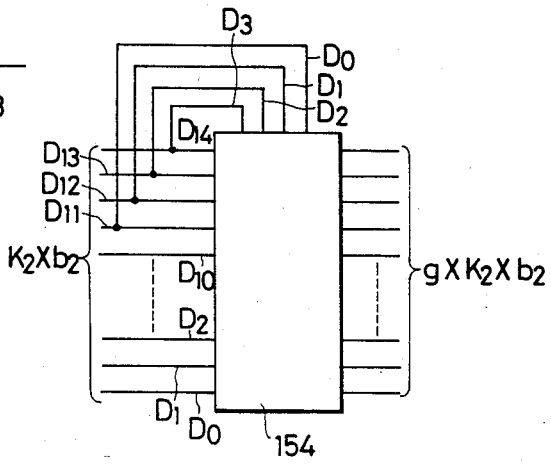

Another embodiment of the invention will be described with reference to FIG. 6. In FIG. 6, reference numeral 154 designates an adder. The adder 154 has a calculation accuracy of the order of 14 bits = 14 bits + 4 bits, since the addition of 14 bits of data and 4 bits of data is 14 bits of data, so that the adder has the same calculation accuracy as the multiplier in FIG. 4 or 5 which also has a calculation accuracy of the order of 14 bits. (FIG. 6 shows the case where the calculation accuracy of the adder is of 14 bits.) One input data of 14 bits to the adder is the result of the multiplication ($K_2 \times b_2(i-1)$) of the multiplier 152, and the other input data of 4 bits are four high-order bits of the result of multiplication, namely, $D_{14}$, $D_{13}$, $D_{12}$, $D_{11}$. In this case, the result of addition in the adder 154 is $K_2 \times b_2(i-1) + K_2 \times b_2(i-1)$ $2^{-10} = (1+2^{-10}) \times K_2 \times b_2(i-1)$. If this addition result is employed as input data to the adder 151 in FIG. 4, then it will be understood that the increasing rate g described above corresponds to $(1+2^{-10})$. In the above-described embodiment, the increasing rate g can be selected only stepwise; however, the object of the invention can be achieved. A specific feature of this embodiment resides in that, unlike the embodiment shown in FIG. 5, it is unnecessary to use multipliers and memories which are intricate in circuit arrangement, and a sinusoidal waveform of small attenuation can be obtained without increasing the circuit scale of the digital filter by much.

Figure 7:
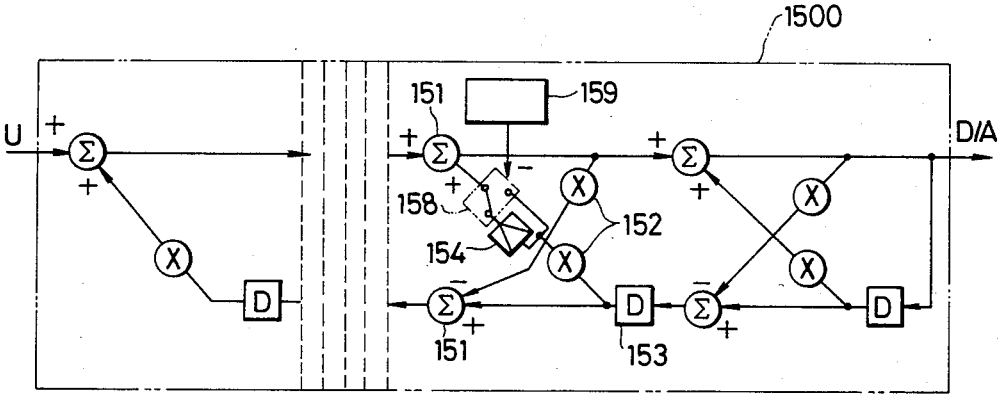

With the speech synthesizer designed as described above, a sinusoidal waveform or a damped oscillation waveform of small attenuation can be obtained without substantially increasing the circuit scale. However, in the case where the increasing circuit 154 employed in the invention is used in synthesizing voices, a divergence phenomenon may take place during the calculation of the digital filter in synthesizing nasal sounds. This drawback is eliminated by the provision of another example of the speech synthesizer according to the invention, which is as shown in FIG. 7. In FIG. 7, reference numeral 158 designates a data selector; and 159, a control signal generator. The control signal generator 159 may be a register which temporarily stores values which are decoded for instance by an amplitude parameter decoder and which includes contents for distinguishing control signals for voice and control signals for musical tones. The control signals are applied as selection signals to the data selector 158. In the case of the control signal for voice, the data selector 158 applies the output of the multiplier 152 directly to the adder 151. In the case of the control signal for musical tones, the data selector 158 applies to the adder 151 a value obtained by increasing the output of the multiplier 152 using the increasing circuit 154. Thus, waveforms of excellent quality can be obtained for both the voice and musical tones.

Figure 8:
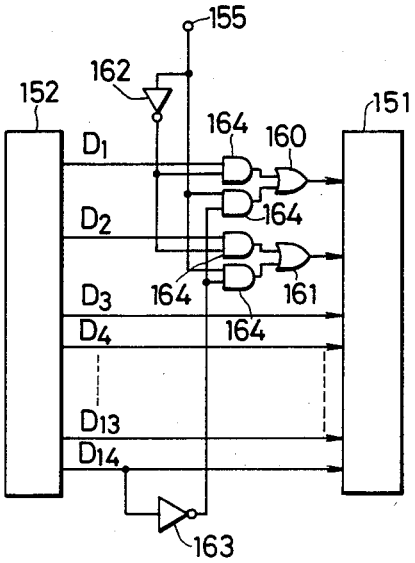

FIG. 8 shows another embodiment of the invention. More specifically, FIG. 8 shows an increasing circuit which increases the absolute value by setting low-order bits of more than one bit (inclusive) to "1" and "0" according to the positive and negative signs of the multiplication result, thus including the function of the switching circuit 158 in FIG. 7. In FIG. 8, reference numeral 155 designates a musical tone and voice identifying signal input terminal. In this embodiment, in response to an identifying signal applied to the input terminal 155, in the case of voice the output of a multiplier 152 is applied directly to an adder 151, and in the case of a musical tone, a value obtained by increasing the output of the multiplier 152 using the increasing circuit is applied to the adder 151. The adder 151 and the multiplier 152 are similar to those in FIG. 4, respectively, and the calculation result thereof is of the fixed point of two's complement of 14 bits. In FIG. 8, reference characters $D_1$ through $D_{14}$ designate multiplication result $K_2 \times b_2(i-1)$ of the multiplier 152; and $D_1$ and $D_{14}$ represent the least significant bit and the most significant bit, respectively. Further in FIG. 8, reference numerals 160, 161 and 164 designate logic gates; and 162 and 163, inverters.

In synthesizing musical tones, the musical tone and voice identifying signal is at "1", and a signal obtained by inverting the sign bit $D_{14}$ is provided at the outputs of the logic gates 160 and 161. If it is assumed that "0" is provided for the positive sign and "1" is provided for the negative sign, for the two low-order bits of the calculation result the signals "1" and "0" are output by the gates 160 and 161 respectively, when the sign is positive and when the sign is negative. Therefore, on average, the absolute value of $K_2 \times b_2(i-1)$ is increased by $\frac{1}{2}(2^{-13}+2^{-12})$. In the case of the conventional digital filter 150, $K_2 \times b_2(i-1)$ is input to the adder 151, while in this embodiment the value applied to the adder is, on average $K_2 \times b_2(i-1)+\frac{1}{2}(2^{-13}+2^{-12})$. Thus, in this embodiment, the absolute value of $K_2$ is equivalently increased and a damped oscillation waveform of smaller attenuation can be obtained.

In synthesizing voices, the musical tone and voice identifying signal is at "0". The logical gates 160 and 161 provide outputs $D_1$ and $D_2$, respectively. The value $K_1 \times b_2(i-1)$ is thus applied to the adder directly (without being increased). In using the increasing circuit 154, no divergence takes place in the course of operation of the digital filter 1500.

Figure 9:
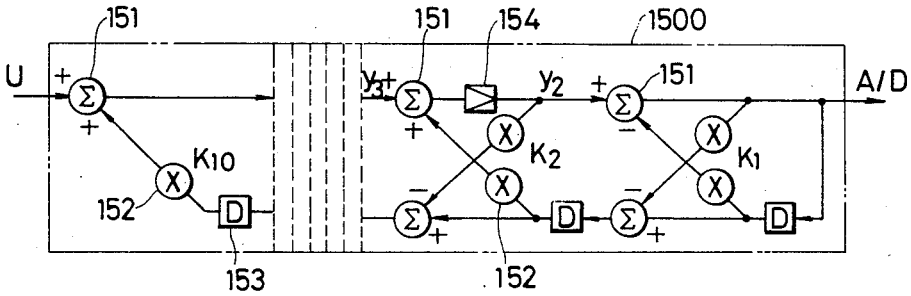

While the increasing circuit 154 is provided at the output side of the multiplier in the above described embodiment of the invention, the increasing circuit 154 may be provided at the position as shown in FIG. 9. FIG. 9 shows another embodiment of the increasing circuit of the invention. The reason why the same effect as that obtained with such a circuit arrangement will now be described. In the conventional digital filter 1500, the value $y_2$ inputted to the adder 151 in the last stage is $y_3+k_2 \times b_2$. In the invention, on the other hand, $K_3$ through $K_{10}$ are zero, and therefore $y_3=U$. Furthermore, U has a peak value A only when $i=1$, and it is zero at the other time instants. Accordingly, $y_2$ is $(A+K_3 \times b_2) \times g = A \times g + (K_2 \times b_2) \times g$ only when $i=1$, and is $(K_2 \times b_2) \times g$ at the other time instants. Thus, with the increasing circuit according to the invention, the value of the exciting signal (impulse) and the value of $K_2$ can be regarded as being equivalently multiplied by the factor g. When the value g is not extremely large, increasing the exciting signal, in proportion to the effect of the filter on the final response waveform, will not distort the waveform. Further, the value of $K_2$ can be regarded as being equivalently multiplied by the factor g, thereby resulting in obtaining a steady sinusoidal waveform small in damping, because of the same reason as described above.

Figure 10:
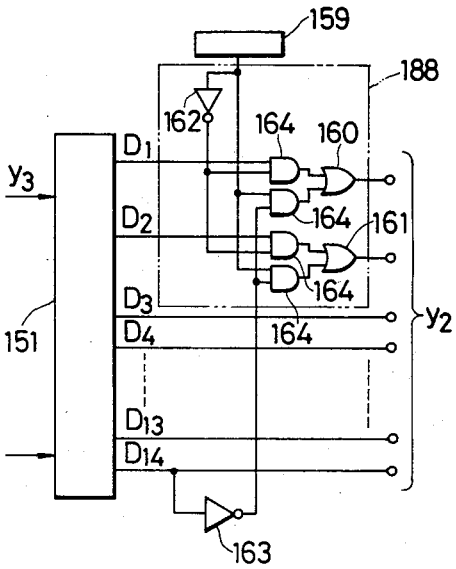

FIG. 10 shows another embodiment of the invention, which corresponds to that of FIG. 8. In FIG. 10, the circuit arrangement of logic gates is identical to that of FIG. 8. The embodiment of FIG. 10 is different from that of FIG. 8 in that the gate circuits 160–164 are provided to the output side of the adder 151. A control signal generating circuit 159 produces musical tone and voice switching signals, and the output terminal thereof corresponds to the musical tone and voice identifying signal input terminal in FIG. 8.

As is apparent from the above description, according to the invention, musical tones such as sinusoidal waves of small distortion can be obtained without increasing the scale of the circuit.

What is claimed is:

1. A partial auto correlation type speech synthesizer, comprising; a lattice-type multi-stage digital filter which comprises a digital tone source signal generating circuit, an adder/subtractor, a delay unit and a multiplier, for extracting a predetermined frequency spectrum component from a exciting signal, and an increasing circuit for slightly increasing the absolute value of a multiplication result for a coefficient K parameter multiplier in a predetermined state of said lattice-type multistage filter, for synthesizing and outputting a sustained sinusoidal waveform or a damped oscillation waveform of long attenuation time.

2. A speech synthesizer as claimed in claim 1, wherein said increasing circuit comprises a memory for storing increasing rates, and a multiplier.

3. A speech synthesizer as claimed in claim 1, wherein said increasing circuit comprises an adder.

4. A speech synthesizer as claimed in claim 1, wherein said increasing circuit comprises means for slightly increasing an absolute value of said multiplication result by setting at least one low-order bit of said multiplication result of a coefficient $K_2$ parameter multiplier in a next to the last stage of said lattice-type multistage filter to one logical level when said multiplication result is positive and to the other logical level when negative.

5. A speech synthesizer as claimed in claims 1, 2, or 3 wherein said increasing circuit slightly increases the absolute value of an addition result of a multiplication result of a coefficient $K_2$ parameter multiplier at a stage one stage before the last stage of said lattice-type multistage filter to a forward wave at a stage located two stages before the last stage of said lattice-type multistage filter.

6. A speech synthesizer as claimed in claims 1, 2, 3, or 4 further including switching means selectively selecting either an output of said increasing circuit or said multiplication result, and control circuit means for operating said switching means to select said increasing circuit output at least when synthesizing substantially sinusoidal waveforms.

* * * * *